United States Patent [19]

Kiff

[11] 4,207,765

[45] Jun. 17, 1980

[54] METHOD AND APPARATUS FOR DETERMINING THE POINT AT WHICH PIPE IS STUCK IN A WELL

[76] Inventor: Edville A. Kiff, 129 Hamilton Rd., Gretna, La. 70053

[21] Appl. No.: 960,580

[22] Filed: Nov. 14, 1978

[51] Int. Cl.[2] ..... E21B 47/00

[52] U.S. Cl. ..... 73/151

[58] Field of Search ..... 73/151; 166/250, 255

[56] References Cited

U.S. PATENT DOCUMENTS

| | | | |
|---|---|---|---|
| 2,530,309 | 11/1950 | Martin | 73/151 |
| 2,534,632 | 12/1950 | Smith | 166/1 |
| 2,851,880 | 9/1958 | Fiedler . | |
| 3,670,566 | 6/1972 | Basham et al. | 73/151 |
| 3,762,218 | 10/1973 | Davis | 73/151 |
| 3,934,466 | 1/1976 | Curry | 73/151 |
| 4,105,071 | 8/1978 | Nicolas et al. | 166/250 |

*Primary Examiner*—Jerry W. Myracle

*Attorney, Agent, or Firm*—David L. Ray; Edgar E. Spielman, Jr.

[57] ABSTRACT

A method and apparatus for determining the location at which a string of pipe is stuck in a well bore. The apparatus has two relatively movable sections and an electrical sensing device for determining relative movement of the two sections which produces a signal representing the movement. The electrical sensing device has a wiper arm adapted to be displaced with a longitudinal deformation of the pipe string and with angular deformation of the pipe string.

11 Claims, 6 Drawing Figures

METHOD AND APPARATUS FOR DETERMINING THE POINT AT WHICH PIPE IS STUCK IN A WELL

BACKGROUND OF THE INVENTION

The present invention relates to an apparatus for determining the point or points at which drill pipe, casing, tubing, or the like is stuck in an earth bore hole. For convenience, the term pipe will be used hereinafter to include casing, tubing, drill pipe, and the like. Although there are many reasons for determining the location at which a pipe is stuck, the principal reasons relate to the removal of the free pipe above the stuck point or the performance of various operations at the stuck point with or without the removal of the pipe. Devices used for determining the stuck point are commonly called freepoint indicators.

The approximate location of the stuck point may be estimated by stretching the free pipe above the stuck point and predicting the location of the stuck point from the physical manifestation of the pipe at the surface. Once the approximate location of the stuck point is known, a freepoint indicating device is lowered into the pipe to locate the actual stuck point. The freepoint indicating device generally consists of a pair of spaced members connected by a sensing means that permits a limited amount of relative movement between the spaced members and produces a signal representing the relative movement. Each of the spaced members includes an anchor assembly that allows the individual member to be connected to the pipe.

When a stuck point or freepoint measurement is to be made, each individual spaced member is connected to the pipe in some manner and a force applied to the upper portion of the pipe. For example, the force may be torque applied to the upper end of the pipe to twist the pipe with the individual spaced members rotating relative to each other or remaining stationary depending upon whether the torque applied to the upper end of the pipe has produced relative rotation of the portions of the pipe engaged by the members. It will be understood that when the torque is applied to the upper end of the pipe, the length of the pipe from the upper end thereof down to the stuck point will twist and that the applied torque will not twist the pipe below the stuck point. Therefore, the operator may lower the device progressively down through the pipe in a step by step order applying a twist to the pipe as each new position of the device in the pipe is established thereby determining for each position of the device whether or not the twist applied to the upper end of the pipe has produced relative rotation of the individual spaced members. When the device passes the stuck point, no relative rotation of the individual spaced members will occur. The operator could, of course, start the test near the lower end of the pipe below the stuck point where no relative rotation of the spaced members of the device occurs and conduct the measurements consecutively upward until the device is brought into a position where the torque applied to the upper end of the drill pipe produces relative rotation to the spaced members.

After the stuck point is located, it may be desirable to remove the free pipe above the stuck point from the well. One method of accomplishing this is by locating the first free joint above the stuck point. A predetermined amount of torque is applied to the pipe and an explosive charge exploded at the free point to break the joint allowing the free pipe to be unscrewed and removed from the well. Under other conditions a device for severing the pipe is positioned at a point above the stuck point. The pipe is severed and the section of pipe thus released withdrawn from the well.

Numerous freepoint indicators have been disclosed in prior art. One such freepoint indicator is disclosed in U.S. Pat. No. 3,934,466 which employs a transducer for measuring the relative longitudinal movement of the upper and lower sections of the device. U.S. Pat. No. 4,105,071 is directed to a freepoint indicator which uses two sensing means, one sensing means to detect angular deformations and the other sensing means to detect longitudinal deformations of a pipe string. Additional freepoint indicators of the prior art are those disclosed in U.S. Pat. Nos. 2,530,309; 2,534,632; 2,851,880; 3,670,566; and 3,762,218.

SUMMARY OF THE INVENTION

The present invention provides a device which may be lowered into a pipe at the end of a cable to locate the point at which the pipe is stuck in a well by providing an indication of relative movement, both angularly and longitudinally, between a pair of spaced members. The device has an upper member and a lower member connected by means for providing relative movement between the upper and lower members both axially and rotatably. The relative movement, both angular and longitudinal, is translated to longitudinal movement of a wiper arm which is detected by sensing means electrically connected to surface indicating equipment.

The present invention has the advantage over the prior art, and particularly over U.S. Pat. No. 3,934,466, in that both rotational and axial or longitudinal relative movement of the upper member and lower member can be measured by simple and durable electronic sensing devices.

The present invention has a further advantage over the prior art in that a single electronic sensing device is employed to detect both rotational relative movement of the upper and lower members and longitudinal or axial relative movement of the upper and lower members.

The present invention has an additional advantage in that it operates on direct current and employs only resistance measurements with the result that the accuracy of the measurements made by the invention is unaffected by the physical properties of the pipe or the earth's magnetic field.

Furthermore, the invention has the advantage that due to simplicity of the construction, the invention requires only the measurement of the difference of DC resistance which greatly reduces the expense of manufacture.

BRIEF DESCRIPTION OF THE DRAWINGS

The invention will be more thoroughly understood by reference to the drawings in which.

DESCRIPTION OF THE PREFERRED EMBODIMENTS

Figure 1:
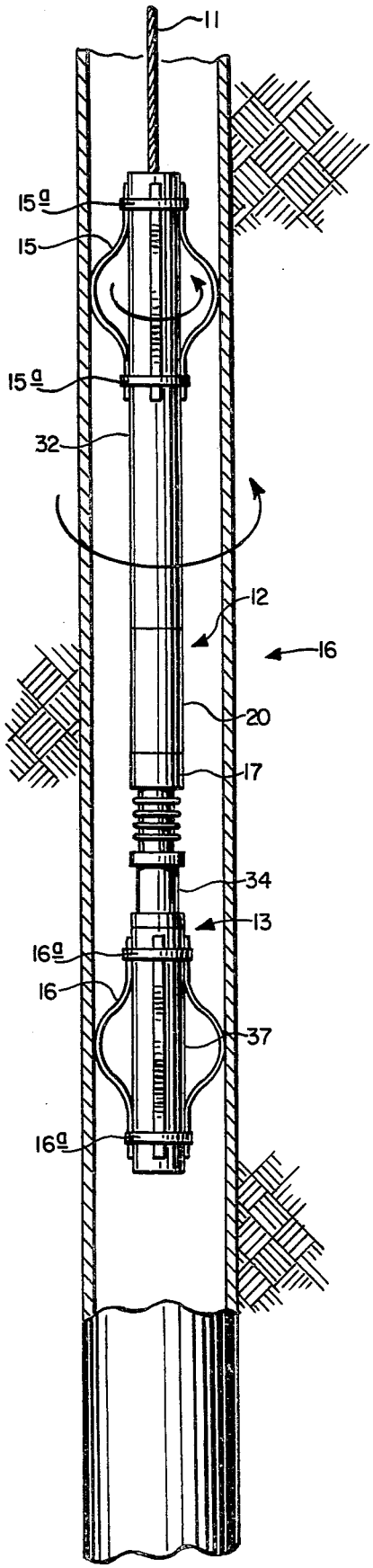
FIG. 1 is a partly sectional view of a drill pipe containing the freepoint indicator of the present invention.

Referring now to the drawings, and more particularly to FIG. 1, the pipe having a stuck section, the location of which is to be determined, is generally indicated by the reference numeral 10. The freepoint indicator is lowered into pipe 10 by cable 11 and has an upper section 12 and a lower section 13. The upper section 12 is connected to the lower section 13 by a flexible boot or bellows 14, and the two sections 12 and 13 can rotate relative to each other and can move in a longitudinal or axial direction relative to each other. The upper section 12 has conventional friction bowsprings 15 thereon and the lower section 13 has conventional bowsprings 16 thereon both of which engage the inner surface of pipe 10. The bowsprings may be connected to pipe 10 by collars 15*a* and 16*a* or by any other conventional means.

Figure 2:
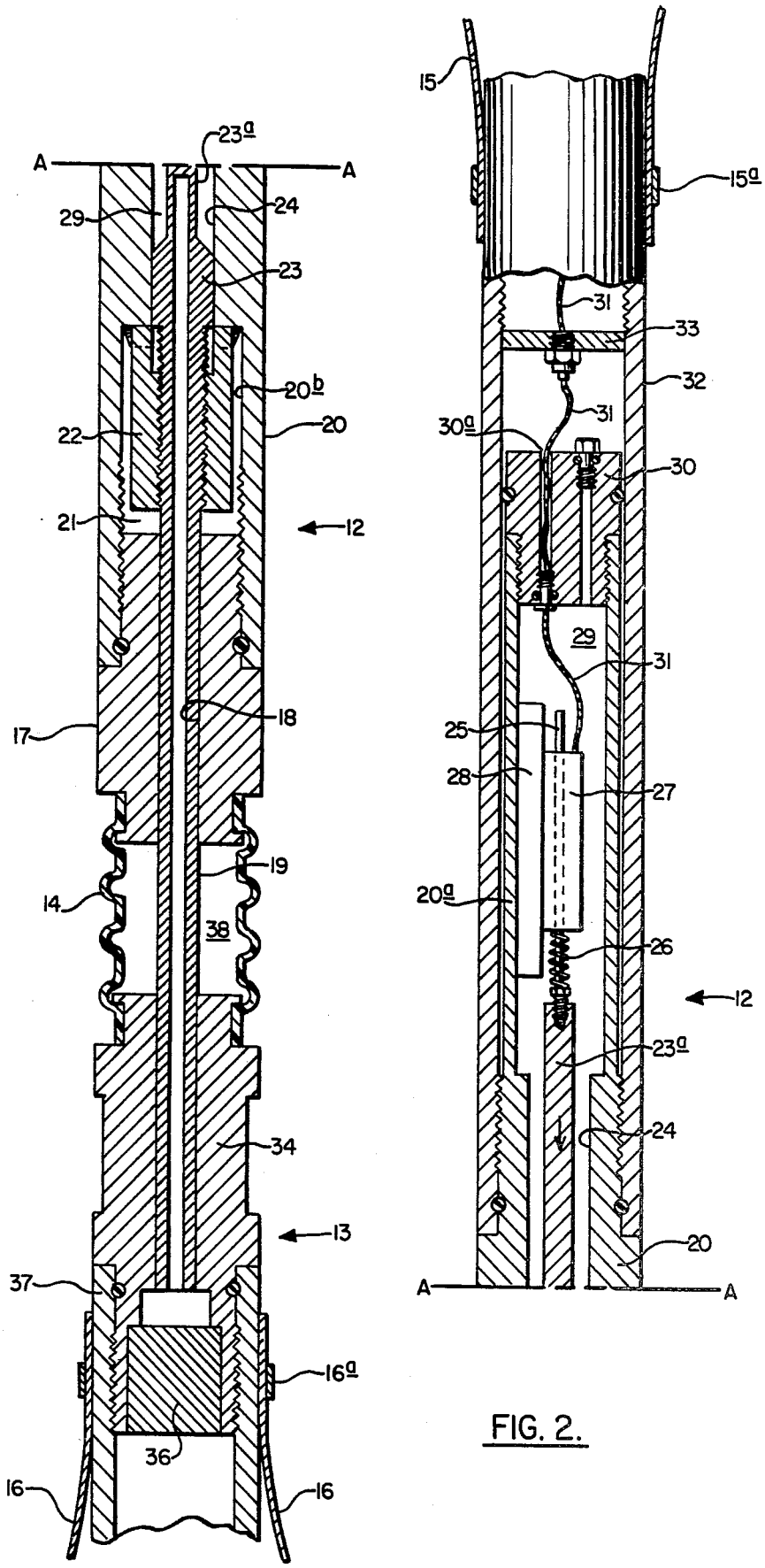
FIG. 2 is a partly sectional, elevational view of the freepoint indicator of the present invention.
Figure 3:
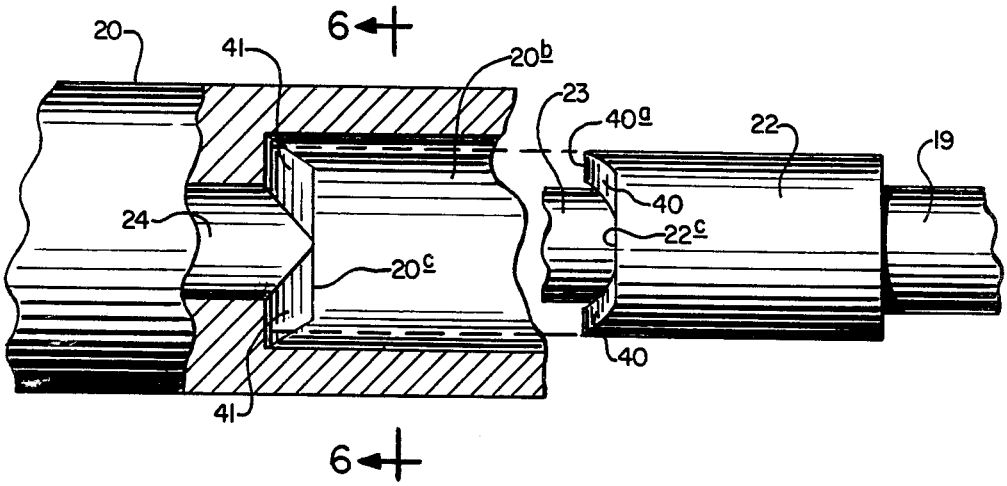
FIG. 3 is an exploded, cut-away, partly cross-sectional view of the caming mechanism of the present invention.

As can be seen in FIG. 2, the upper section 12 includes a cylindrical plug 17 having cylindrical hole 18 therein for slidable and rotatable receipt of rod 19 which is movable within hole 18. Threaded to plug 17 is casing 20 which has a cavity 21 therein. Threaded to movable rod 19 is cam 22 which can also be seen in more detail in FIGS. 3, 4, and 5. Extending upwardly from the end of cam 22 and threaded thereto is rod 23 which is slidably and rotatably received in the cylindrical hole 24 in casing 20.

Rod 23 has a reduced diameter section 23*a* which extends upwardly and is threaded to wiper rod 25. Wiper rod 25 has a spring 26 thereon to bias rod 23*a* downward. Wiper rod 25 extends through the transducer which is generally indicated by the numeral 27. Transducer 27 is rigidly connected by base plate 28 to the interior wall of a reduced diameter section of casing 20, indicated by the numeral 20*a*. The reduced diameter section 20*a* of casing 20 defines a cavity 29 which is preferably filled with oil. The oil can flow downward in cavity 29 around rod 23 to fill cavity 21 and downwardly around rod 19 to fill cavity 38 between rod 19 and boot 14. The cavities are filled with oil to prevent boot 14 from collapsing due to pressure on the outside of the freepoint indicator.

Closing the end of reduced diameter section 20*a* in cavity 29 is plug 30 which is threaded to the upper end of reduced diameter section 20*a*. Extending upward through hole 30*a* in plug 30 are two wires 31 which extend upward to surface sensing equipment. Threaded to casing 20 is casing 32 which contains in its upper end flange 33 through which wires 31 extend.

The lower section 13 of the freepoint indicator of the present invention is connected to boot 14 by cylindrical plug 34 having a hollow channel 35 therein for rigid receipt of rod 19. Plug 34 contains an additional plug 36 in the lower end thereof. At the lower end of plug 34 is lower casing 37 to which bowspring 16 is connected.

In operation the freepoint indicator is anchored to the pipe by bowsprings 15 and 16. The upper section 12 can rotate relative to the lower section 13 and the upper section 12 can move upwardly or downwardly in a longitudinal or axial direction relative to the lower section 13 since the upper section and lower section are connected by a flexible boot 14 and rod 19 can rotate and move upwardly and downwardly within channel 18 of casing 17 and channel 24 of casing 32.

When upper section 12 rotates relative to lower section 13, rod 19, cam 22, rod 23, rod 23*a*, and wiper rod 25 are displaced upwardly or downwardly in a longitudinal or axial manner depending upon the angular direction of rotation. Such longitudinal displacement is achieved by cam 22 and tapered seat 41 on which cam 22 rests.

Figure 4:
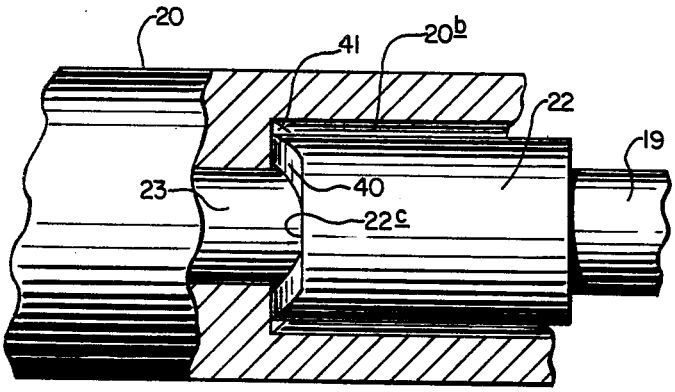
FIG. 4 is a partly cross-sectional, cut-away view of the caming mechanism of the present invention.
Figure 6:
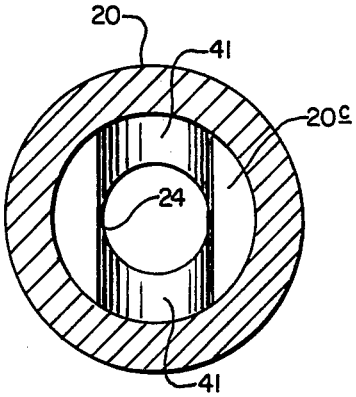
FIG. 6 is a cross-sectional view along lines 6—6 of FIG. 3.

As can be seen in FIGS. 3-6, cam 22 has two tapered upper surfaces indicated by the numeral 40—40 which mate with two tapered seats 41—41 of casing 20. Cam 22 also has a flat surface 22*c* shown in FIGS. 3, 4, and 5 which mates with the flat surface 20*c* molded into casing 20 which is shown in detail in FIG. 6, and also in FIGS. 3 and 5. In FIG. 4, cam 22 is shown inserted in casing 20 in its uppermost position with tapered surface 40 contacting tapered seat 41 of casing 20.

Figure 5:
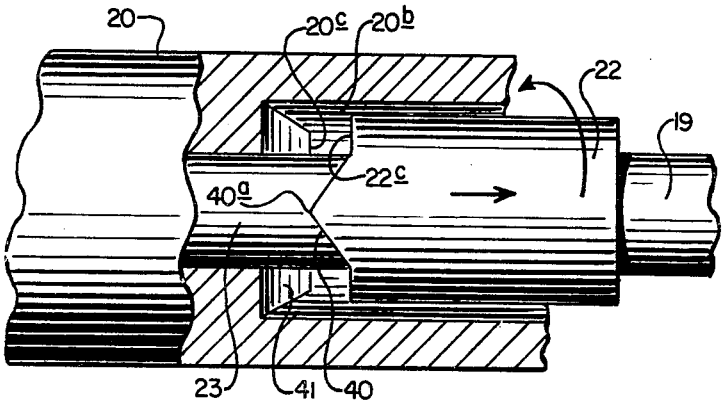
FIG. 5 is a view of FIG. 4 in which rotation has occurred.

In FIG. 5, cam 22 is shown rotated 90 degrees from the view shown in FIG. 4. Thus, cam 22 has been forced in the direction indicated by the arrow in FIG. 5 relative to casing 20 when rotated 90 degrees. The uppermost point of tapered surface 40, which is indicated by the numeral 40*a*, rests on flat surface 20*c* of casing 20. Thus, rotation of the upper section 12 relative to lower section 13 achieves a longitudinal or axial displacement of cam 22 which is rigidly connected to rods 19, 23, and 23*a* and wiper 25. As wiper 25 moves in transducer 27, the amount of movement is detected by transducer 27 and transmitted to surface detection equipment through wires 31.

Furthermore, since rod 19 is rigidly affixed to plug 34 in lower section 13 when upper section 12 is moved upwardly relative to the lower section 13, wiper rod 25 is moved downwardly relative to transducer 27. This downward movement varies the signal from transducer 27 allowing surface equipment to detect the amount of downward movement of lower section 13 relative to upper section 12.

The approximate location of the stuck point may be estimated by stretching the free pipe above the stuck point and predicting the location of the stuck point from the physical manifestation of the pipe at the surface. Once the approximate location of the stuck point is known, the freepoint indicating device is lowered into the pipe to locate the actual stuck point.

When a stuck point or freepoint measurement is to be made, the upper section 12 and lower section 13 is connected to pipe 10 by bowsprings 15 and 16 and a force applied to the upper portion of the pipe. For example, the force may be torque applied to the upper end of pipe 10 to twist the pipe with the individual spaced sections 12 and 13 rotating relative to each other or remaining stationary depending upon whether the torque applied to the upper end of the pipe has produced relative rotation of the portions of the pipe engaged by the members. It will be understood that when the torque is applied to the upper end of the pipe, the length of the pipe from the upper end thereof down to the stuck point will twist and that the applied torque will not twist the pipe below the stuck point. Therefore, the operator may lower the device progressively down through the pipe in a step by step order applying a twist to the pipe as each new position of the device in the pipe is established thereby determining for each position of the device whether or not the twist applied to the upper end of the pipe has produced relative rotation of the individual spaced members. When the device passes the stuck point, no relative rotation of the individual spaced members will occur. The operator could, of course, start the test near the lower end of the pipe below the stuck point where no relative rotation of the spaced members of the device occurs and conduct the measurements consecutively upward until the device is brought into a position where the torque applied to the upper end of the drill pipe produces relative rotation to the spaced members.

In addition, the force may be an upward force applied to the upper end of pipe 10 to displace the pipe in a longitudinal direction with the individual spaced sections 12 and 13 moving in a longitudinal direction relative to each other or remaining stationary depending upon whether the upward force applied to the upper end of the pipe has produced longitudinal movement of the portions of the pipe engaged by the members. It will be understood that when the upward force is applied to the upper end of the pipe, the length of the pipe from the upper end thereof down to the stuck point will stretch or strain and that the applied force will not stretch or strain the pipe below the stuck point. Therefore, the operator may apply a torque and/or upward force as the freepoint indicator moves down through the pipe to determine for each position of the device whether or not the twist or upward force applied to the upper end of the pipe has produced relative rotation or longitudinal displacement of the individual spaced members. When the device passes the stuck point, no relative rotation or longitudinal displacement of the individual spaced members will occur.

Having fully described the invention, it is desired that it be limited only within the spirit and scope of the attached claims.

What is claimed:

1. An apparatus adapted to be suspended from an electrical cable and operated at different locations in a string of pipe to obtain measurements representative of deformations occuring therein in response to the application of forces to its upper end for determining at least the approximate location at which the string of pipe may be stuck in a well bore comprising:

a. upper section means and lower section means including upper and lower wall engaging means adapted for respectively establishing anchoring engagement with the adjacent spatially-disposed wall surfaces of the pipe string;

b. single transducer means cooperatively arranged in said upper section means adapted for producing an output signal responsive to longitudinal deformations occuring in an incremental length of a pipe string when an upward force is applied to the surface end of said pipe string or to angular deformations occuring in an incremental length of a pipe string when torque is applied to the surface end of said pipe string; and, c. means for translating said angular deformations and said longitudinal deformations to longitudinal displacement of wiper arm means contained in said transducer including cam means rotatably received in said upper section, said cam means having lower rod means rigidly connected to said lower section means and upper rod means rigidly connected to said wiper arm means.

2. The apparatus of claim 1 wherein said upper rod means is rotatably received in said upper section means.

3. The apparatus of claim 2 wherein said flexible boot means filled with oil is connected to said upper section and said lower section.

4. A method for determining the location at which a string of pipe is stuck in a well bore, comprising:

a. moving a deformation-responsive sensor having a single sensing means responsive to longitudinal deformation of the pipe string and to angular deformation of the pipe string to a selected depth location within said pipe string, said sensor having means at each end thereof for engaging the inner wall surfaces of said pipe string;

b. applying an upward force on said pipe string while simultaneously monitoring output signals from said sensing means for detecting whether a corresponding longitudinal deformation is being induced in the incremental length of said pipe string between said upper and lower wall surfaces thereby demonstrating that said incremental length of said pipe string is at least partially situated above said location in which said pipe may be stuck; and, c. releasing said upward force on said pipe string and applying an angular force to the surface end of said pipe string while simultaneously monitoring said single sensing means for detecting whether a corresponding angular deformation is then being induced in the incremental length of said pipe string between said upper and lower wall surfaces thereby demonstrating that said incremental length of said pipe string is at least partially situated above said location at which said pipe may be stuck, said angular deformation being translated to longitudinal displacement of wiper arm means contained in said sensing means.

5. The method of claim 4 wherein said single sensing means is a transducer.

6. The method of claim 4 wherein said longitudinal deformation is translated to longitudinal displacement of said wiper arm means contained in said sensing means.

7. An apparatus adapted to be suspended from an electrical cable and operated at different locations in a string of pipe to obtain measurements representative of deformations occuring therein in response to the application of forces to its upper end for determining at least the approximate location at which the string of pipe may be stuck in a well bore comprising:

a. upper and lower section means including upper and lower wall engaging means adapted for respectively establishing anchoring engagement with the adjacent spatially-disposed wall surfaces of the pipe string; and, b. single sensor means cooperatively arranged in said upper section means adapted for producing an output signal responsive to longitudinal deformations occuring in an incremental length of a pipe string when an upward force is applied to the surface end of said pipe string or to angular deformations occuring in an incremental length of a pipe string when torque is applied to the surface end of said pipe string, said apparatus having means for translating said angular deformation to longitudinal displacement of wiper arm means contained in said sensor means.

8. The apparatus of claim 7 wherein said single sensor means is a transducer.

9. The apparatus of claim 7 wherein said longitudinal deformation is translated to longitudinal displacement of said wiper arm means contained in said sensor means.

10. The apparatus of claim 9 wherein said means for translating includes cam means.

11. The apparatus of claim 10 wherein said sensor means is a transducer.

* * * * *